US005164537A

United States Patent [19]

Fritz et al.

[11] Patent Number: 5,164,537

[45] Date of Patent: Nov. 17, 1992

[54] SMALL FIREARM WITH RECEIVER

[75] Inventors: Raimund Fritz, Trossingen; Norbert Fluhr, Oberndorf; Berthold Weichert, Zimmern, all of Fed. Rep. of Germany

[73] Assignee: Heckler & Koch GmbH, Oberndorf am Neckar, Fed. Rep. of Germany

[21] Appl. No.: 687,924

[22] PCT Filed: Nov. 10, 1989

[86] PCT No.: PCT/DE89/00707

§ 371 Date: Jun. 3, 1991

§ 102(e) Date: Jun. 3, 1991

[87] PCT Pub. No.: WO90/06484

PCT Pub. Date: Jun. 14, 1990

[30] Foreign Application Priority Data

Dec. 8, 1988 [DE] Fed. Rep. of Germany ..... 3841292

[51] Int. Cl.[5] ..... F41A 13/00

[52] U.S. Cl. ..... 89/199; 89/1.2

[58] Field of Search ..... 89/199, 1.2, 14.1, 1.1

[56] References Cited

U.S. PATENT DOCUMENTS

| | | | |
|---|---|---|---|
| 2,442,773 | 6/1948 | Mason | 181/223 |
| 2,448,382 | 8/1948 | Mason | 89/14 |
| 2,791,940 | 5/1957 | Speake et al. | 89/1.2 |
| 2,807,986 | 10/1957 | Howard et al. | 89/1.2 |
| 2,814,972 | 12/1957 | Simmon | 89/193 |
| 3,005,279 | 10/1961 | Brewer | 42/18 |
| 3,013,355 | 12/1961 | Weatherby | 42/16 |
| 3,118,342 | 1/1964 | Campione | 89/1.2 |
| 3,968,727 | 7/1976 | Hyytinen | 89/191.02 |
| 4,007,908 | 2/1977 | Smagghe et al. | 251/127 |

FOREIGN PATENT DOCUMENTS

| | | |
|---|---|---|
| 2544995 | 10/1975 | Fed. Rep. of Germany . |
| 138949 | 5/1918 | United Kingdom . |
| 1547563 | 3/1975 | United Kingdom . |

*Primary Examiner*—David H. Brown

*Attorney, Agent, or Firm*—Walter A. Hackler

[57] ABSTRACT

A hand firearm with a casing in which the system is arranged and a valve leading from the inside of the casing to the outside which is so designed that an overpressure in the casing may be vented to the outside, in which a gas-permeable, heat conducting solid medium is arranged in the region of the valve in the flow path of the gas leaving via the valve in order to prevent any danger from hot gases being forced out of the weapon.

7 Claims, 1 Drawing Sheet

SMALL FIREARM WITH RECEIVER

BACKGROUND OF THE INVENTION

The present invention relates to a small firearm having a receiver for accommodating the system, and a valve which connects the interior of the receiver with the outside and which is designed in such a way that overpressure occurring in the receiver can be evacuated to the outside. There is always a risk in known firearms of the described type that explosive gases may gather in the receiver which may ignite when the firearm is fired. This risk exists in particular when the firearm, which may be an automatic or a semi-automatic weapon, belongs to the class using caseless ammunition where the entire mechanism of the firearm is enclosed in a case which takes the form of the stock and which is in the closed condition when the weapon is ready to fire. If the overpressure occurring when the explosive components ignite in the case is evacuated to the outside through a valve in order to prevent the case from being destroyed, there is the risk that damage may be caused by the hot gases escaping through the valve.

U.S. Pat. No. 2,814,972 describes a firearm with a closed receiver comprising a valve through which an overpressure arising inside the receiver can be evacuated to the outside. The flow path to be taken by the gas is designed as a labyrinth in which the gas is deflected several times and which guarantees that the flame of the burning gas will not emerge from the firearm. However, a labyrinth-like design of the flow path for the gas is very expensive and requires much space.

Further, it has been known from DE-C 25 44 995 to equip firearms having closed receivers with overpressure valves by means of which excessively high pressures occurring inside the firearm can be relieved. However, such relief valves are connected with the disadvantage that they are very sensitive to ingress of dirt, such as sand or the like, and that the cross-sectional surface available as gas outlet is relatively small. The receiver is dust-tight and water-tight, but not gas-tight. The rate of pressure rise inside the firearm is very high, in spite of such relief valves.

SUMMARY OF THE INVENTION

Proceeding from this known state of the art, it is the object of the present invention to design a firearm of the kind described at the outset in such a way that in the event explosive components should ignite inside the receiver the resulting overpressure can be evacuated to the outside without any risk.

The invention achieves this object by the fact that a heat-dissipating solid medium which is permeable to gas is arranged in the area of the valve, in the flow path of the gasses escaping through the valve.

In particular, the medium may consist of a suitable metal, such as steel, which effects rapid cooling-down of the gas flow passing the valve so that the hot gas flow can no longer hurt the shooter. One must consider in this connection that the valve is passed by the hot gas flow not continuously, but only at longer time intervals so that the described medium is permitted to cool down sufficiently during such intervals. The cooling effect can be further supported by bringing the heat-dissipating medium in contact with larger metal parts. Or else the thermal energy can be removed from the gas flow passing the valve by giving the medium a sufficiently high heat capacity in which case it is not necessary for the medium to be in a position to carry off the heat with sufficient rapidity, for example to a holder of the medium. The design using a grate, meshes or a mat presents the advantage that the relatively space-consuming structure of a labyrinth can be avoided.

The advantage of the invention resides in the fact that the heat-dissipating medium, which according to one embodiment of the invention may take the form of a grid, of meshes or mats and which, in particular, may consist of a suitable metal, such as steel, effects rapid cooling-down of the gas flow passing the valve so that the hot gas flow can no longer hurt the shooter. One must consider in this connection that the valve is passed by the hot gas flow not continuously, but only at longer time intervals so that the described medium is permitted to cool down sufficiently during such intervals. The cooling effect can be further supported by bringing the heat-dissipating medium in contact with larger metal parts. Or else the thermal energy can be removed from the gas flow passing the valve by giving the medium a sufficiently high heat capacity in which case it is not necessary for the medium to be in a position to carry off the heat with sufficient rapidity, for example to a holder of the medium.

An additional cooling effect for the gasses can be provoked by the medium if the latter disturbs the laminar flow of the gas so as to create turbulences and a cooling effect.

For design reasons, the medium should conveniently be arranged in the flow cross-section of the valve. Preferably, the medium may be arranged in the flow path of the gasses upstream of a valve gasket so that the gasket will not be exposed to the hot gasses.

Particularly efficient cooling of the gasses can be achieved if according to one embodiment of the invention, at least two heat-dissipating media are provided in the flow path of the gasses at a certain distance one from the other.

According to certain embodiments of the invention, a moving part of the valve may be arranged at the outside of the valve. This protects the inside of the valve efficiently from contamination by dirt penetrating into the firearm from its outside.

According to other embodiments of the invention, the moving part of the valve is arranged near a gas inlet of the valve and a movable cap is arranged at the gas outlet of the valve and is supported resiliently, independently of the moving valve part. The described arrangement of the moving valve part prevents the dirt particles whirling about inside the receiver during use of the firearm from settling in the gas-permeable medium. The gasses reach the medium only when overpressure occurs.

According to one embodiment of the invention, a baffle may be provided for the gas flow in the flow path of the gasses, upstream of the valve gasket, for the purpose of cooling down the gas flow. This baffle guides the gas flow along large-surface of metal parts of the valve whereby it is cooled down efficiently.

BRIEF DESCRIPTION OF THE DRAWING

Other features and advantages of the invention will appear from the claims and from the following description of certain embodiments of the invention given by reference to the drawing which shows essential details of the invention, it being understood that the individual features may be implemented in any embodiment of the invention individually or in any combination thereof. In the drawing

DETAILED DESCRIPTION

Figure 1:
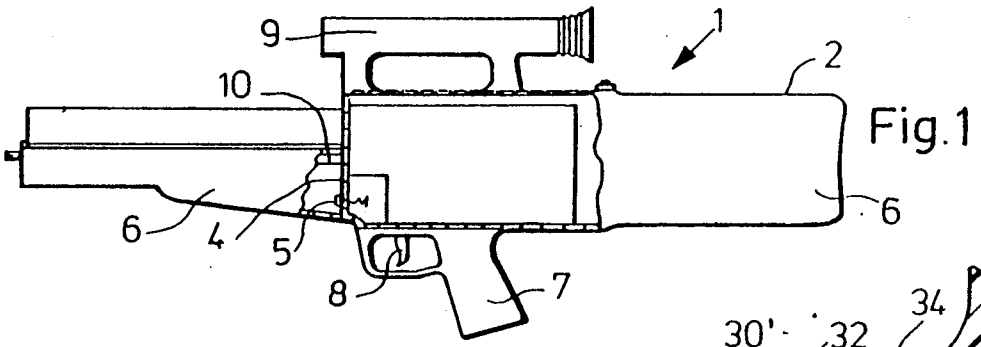
FIG. 1 shows a simplified side view of an automatic firearm, partly broken away.

The simplified view of FIG. 1 shows that the firearm 1, which comprises a receiver 2 accommodating the mechanism of the firearm—not shown in the drawing—comprises a valve 5—indicated only diagrammatically—which is arranged in a receiver wall 4 and which opens when an overpressure occurs in the receiver 2. The receiver 2 is water-tight and dust-tight. Except for the valve, the orifice of the barrel is the only opening in the receiver. The valve 5 is located in the area of the stock 6. Without certain special measures, which will be explained in more detail further below, hot gasses escaping from the valve 6 might possibly injure the shooter because the valve 5 is to be located at the indicated position in the illustrated example and is not to be arranged in a different position in this particular design.

Figure 3:
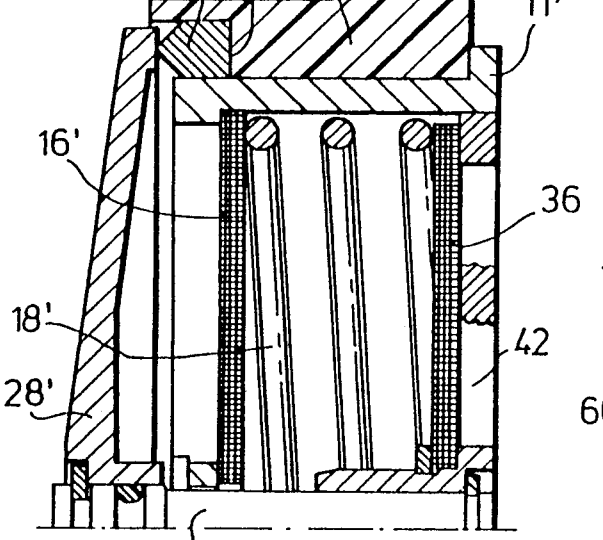
FIG. 3 shows a longitudinal section through a second embodiment of a valve.
Figure 4:
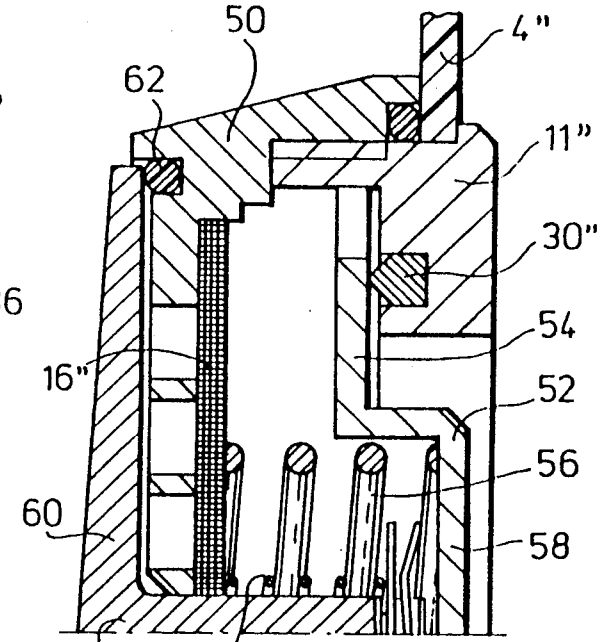
FIG. 4 shows a longitudinal section through a third embodiment of a valve.
Figure 2:
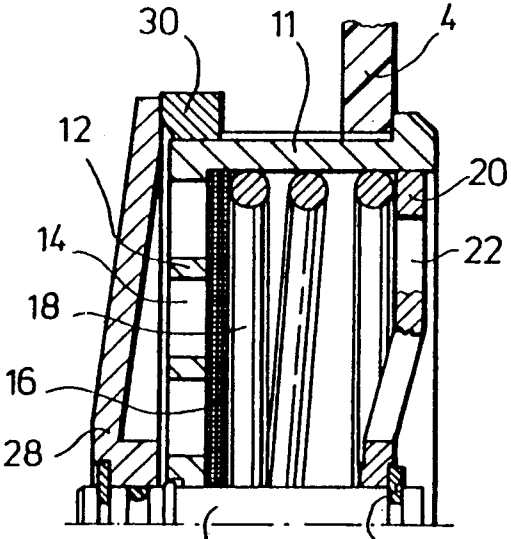
FIG. 2 shows a longitudinal section through a first embodiment of a valve.

The valve is rotationally symmetrical and each of FIGS. 2 to 4 shows the upper half of an axial section.

In FIG. 2, the valve 5 is seated in a bore of the receiver wall 4 of the receiver 2 and fixed therein in a manner not shown in detail. The valve 5 comprises a cylindrical housing 11 with a supporting element 12 having the shape of a disk, which comprises larger openings 14, formed integrally with the valve housing 11 which is arranged at its left end portion, i.e. near the side where the gasses leave the valve. The supporting element 12 serves as support for a wire grid 16 made from steel wire. On its other side, the wire grid 16 is held in engagement with the supporting element 12 by a pressure spring 18 in the form of a coil spring. The other end of the coil spring 18 bears against a disk 20 which, just as the supporting element 12, is provided with openings 22 to serve as passages for the gas. The disk 20 is mounted to slide in the valve housing 11. Seated centrally in the valve housing 11 is a bolt 24 to which the force of the coil spring 18 which acts to the right in FIG. 2 is transmitted via the disk 20 and a spring washer 26 fitted in a groove of the bolt 24 whereby the bolt 24 is biased to the right, as viewed in FIG. 2. The left outer end of the bolt 24 carries a valve disk 28 which rests against a gasket 30 arranged on the outside of the valve housing 11.

When a sufficiently high pressure is exerted on the valve disk 28 from the right, as viewed in FIG. 2, then the valve disk 28 lifts off the gasket 30, against the force of the coil spring 18. The gasses flowing through the valve 5 pass the wire grid 16 whereby they are cooled down so that the gasses escaping to the outside can no longer endanger the shooter or the environment. Additional cooling of the gasses escaping to the outside is effected by the fact that the valve disk 28 deflects the gasses radially to the outside whereby the gas flow is spread additionally.

In the case of the embodiment of a valve 5' illustrated in FIG. 3, the gasket 30' is inserted in a continuous shoulder 32 on a portion of the wall 4' of the receiver of the firearm which is designed as tubular seat for the valve 5'. Elements which are similar to those of the arrangement according to FIG. 2 are identified by primed reference numerals. The embodiment according to FIG. 3 differs from that according to FIG. 2 essentially in that in addition to the wire grid 16' disposed at the same side as in FIG. 2, a further a wire grid, identified by reference numeral 36, is provided near the side where the hot gasses enter the valve. In order to enable a plane wire grid 36 to be used, the disk 42 is also plane, contrary to the arrangement of FIG. 2 where the central portion of the disk 20 displays a funnel-like shape. Again, the disk 42 is mounted to slide in the valve housing 11' and to transmit the force of the coil spring 18' to the bolt 24' and from there to the valve disk 28'.

Referring now to the embodiment illustrated in FIG. 4, primed identical reference numerals are again used to identify identical similar parts. The valve 5'' is seated in a base of the receiver wall 4''. The valve housing consists of two parts 50 and 11'' which are screwed together. The gasket 30'' of the valve 5'' is located in this case near the side where the gas enters the valve, and the spiral spring 56, which again bears against the wire grid 16'' arranged near the gas outlet side, bears by its other end upon a movable valve part 52 whose plane flange portion 54 rests against the gasket 30'' and whose central portion 58 displays a cup-like deformation pointing to the right in FIG. 4, this cup-like area being engaged by the coil spring 58. The hot gasses arriving from the right, as viewed in FIG. 4, are deflected by a right angle, due to the described shape of the valve portion 52, which thus serves as a deflection means or baffle means, and are caused to flow past the gasket 30'', with the valve part 52 in open position. Due to this deflection, the hot gasses sweep over a big area of the valve part 52 whereby they are cooled efficiently. In addition to cooling the gasses the design of the valve part 52 as a labyrinth in the flow path effects a pressure drop between the valve part 52 and the medium. A further pressure drop occurs between the medium and the sealing cap 60. Further cooling occurs as the gasses flow through the wire grid 16''. At the point where the movable valve part 28 and the valve disk 28', respectively, are arranged in the case of the valves illustrated in FIGS. 2 and 3, there is provided in FIG. 4 the movable sealing cap 60 which coacts with a gasket 62 in the form of an O-ring. The sealing cap 60 is biased to the right by a relatively weak pressure spring 64 acting between the wire grid 16'' on the one side and a spring washer fitted at the bolt 24'' on the other side. The spring 64 being weak in relation to the pressure spring 56, the sealing 60 does not increase the flow resistance of the valve too much.

The spring 64 is adapted to the reduced gas pressure acting at the sealing cap 60 so that in border-line cases the valve 52 will lift off without causing the sealing cap 60 to open.

A rigid connection of simplified design between the movable valve part and the sealing cap may be sufficient if the location is selected conveniently to guarantee the shooter's safety.

We claim:

1. In a small firearm having a receiver for accommodating a firearm mechanism, and valve which connects means connecting an interior of the receiver with the outside, for evacuating overpressure occurring in the receiver, wherein the improvement comprises a heat-dissipating solid medium, said heat-dissipating solid medium being permeable to gas and disposed in a flow path of gasses escaping through the valve, the medium comprising a structure selected from a group of structures consisting of a grate, a mesh and a mat.

2. Firearm according to claim 1, wherein the improvement comprises at least two heat-dissipating media disposed in the flow path of the gases at a certain distance one from the other.

3. Firearm according to claim 1 the improvement further comprises baffle means disposed in the flow path of the gasses, upstream of a valve gasket, for cooling the gas flow.

4. Firearm according to claim 1, wherein the medium is arranged in a flow cross-section of the valve.

5. Firearm according to claim 4, wherein the medium is arranged in the flow path of the gasses upstream of a gasket of the valve.

6. Firearm according to claim 1, wherein a moving part of the valve is arranged outside of the valve.

7. Firearm according to claim 5 wherein the moving part of the valve is arranged near a gas inlet of the valve and a movable sealing cap is arranged at a gas outlet of the valve and is supported resiliently, independently of the moving valve part.

* * * * *